US008329004B2

(12) United States Patent
Georgia

(10) Patent No.: US 8,329,004 B2
(45) Date of Patent: Dec. 11, 2012

(54) POLYMERIC, NON-CORROSIVE CATHODIC PROTECTION ANODE

(75) Inventor: Michael Steven Georgia, Rhome, TX (US)

(73) Assignee: AEP & T, LLC, Benbrook, TX (US)

( * ) Notice: Subject to any disclaimer, the term of this patent is extended or adjusted under 35 U.S.C. 154(b) by 164 days.

(21) Appl. No.: 12/935,879

(22) PCT Filed: Mar. 26, 2009

(86) PCT No.: PCT/US2009/038423

§ 371 (c)(1),
(2), (4) Date: Dec. 27, 2010

(87) PCT Pub. No.: WO2009/145994

PCT Pub. Date: Dec. 3, 2009

(65) Prior Publication Data

US 2011/0100802 A1 May 5, 2011

Related U.S. Application Data

(60) Provisional application No. 61/072,373, filed on Mar. 31, 2008.

(51) Int. Cl.
*C23F 13/08* (2006.01)
*C23F 13/10* (2006.01)
*C23F 13/12* (2006.01)

(52) U.S. Cl. ..... 204/196.37; 204/196.1; 204/196.21; 204/196.36

(58) Field of Classification Search ..... 204/196.01, 204/196.1, 196.21, 196.36, 196.37
See application file for complete search history.

(56) References Cited

U.S. PATENT DOCUMENTS

| | | | |
|---|---|---|---|
| 3,133,872 | A | 5/1964 | Miller et al. |
| 3,629,007 | A | 12/1971 | Kilduff |
| 3,751,301 | A | 8/1973 | Kilduff |
| 3,798,142 | A | 3/1974 | Evans et al. |
| 3,868,313 | A | 2/1975 | Gay |
| RE29,419 | E | 9/1977 | DeCraene |
| 4,117,065 | A | 9/1978 | Tsien et al. |
| 4,118,294 | A | 10/1978 | Pellegri |
| 4,186,075 | A | 1/1980 | Kempter et al. |
| 4,255,241 | A | 3/1981 | Kroon et al. |

(Continued)

FOREIGN PATENT DOCUMENTS

| | | | |
|---|---|---|---|
| JP | 63-096297 | A | 4/1988 |

(Continued)

*Primary Examiner* — Bruce Bell
(74) *Attorney, Agent, or Firm* — Daniel J. Chalker; Edwin S. Flores; Chalker Flores, LLP

(57) ABSTRACT

An apparatus for protection of metallic materials from corrosion comprising an electrical power source (5) and a conductor (7) coupled to the power source. An anode (11) is electrically coupled to the conductor. The anode is configured to be secured proximal to the metallic materials to be protected from corrosion and has an exterior surface (13) formed predominantly of electrically conductive polymer and an interior filled with particulate carbonaceous material. The anode comprises a hollow cylinder (13) formed of electrically conductive polymer, the cylinder having an interior. A metallic tube (15) is secured to and in electrical communication with the interior of the cylinder. An anode conductor (17) is electrically coupled to the metallic tube and extends from the interior of the cylinder to the exterior of the cylinder for connection to the conductor coupled to the power source.

28 Claims, 3 Drawing Sheets

U.S. PATENT DOCUMENTS

| | | | | | |
|---|---|---|---|---|---|
| 4,285,796 | A | | 8/1981 | Stoner et al. | |
| 4,360,417 | A | | 11/1982 | Reger et al. | |
| 4,400,259 | A | * | 8/1983 | Schutt | 204/196.33 |
| 4,401,540 | A | * | 8/1983 | Tatum et al. | 204/196.36 |
| 4,414,092 | A | | 11/1983 | Lu et al. | |
| 4,425,217 | A | | 1/1984 | Beer | |
| 4,454,169 | A | | 6/1984 | Hinden et al. | |
| 4,459,189 | A | | 7/1984 | Vance et al. | |
| 4,473,450 | A | | 9/1984 | Nayak et al. | |
| 4,502,929 | A | | 3/1985 | Stewart et al. | |
| 4,511,442 | A | | 4/1985 | Pellegri | |
| 4,528,084 | A | | 7/1985 | Beer et al. | |
| 4,544,464 | A | * | 10/1985 | Bianchi et al. | 205/724 |
| 4,619,753 | A | | 10/1986 | Christen et al. | |
| 4,880,517 | A | | 11/1989 | Bennett et al. | |
| 5,040,599 | A | * | 8/1991 | Pfalser et al. | 166/248 |
| 5,080,773 | A | * | 1/1992 | Tatum, Jr. et al. | 204/196.34 |
| 5,183,694 | A | | 2/1993 | Webb | |
| 6,051,118 | A | | 4/2000 | Asaki et al. | |
| 6,514,401 | B2 | | 2/2003 | Chyou et al. | |
| 6,673,309 | B1 | | 1/2004 | Watanabe et al. | |
| 7,186,321 | B2 | * | 3/2007 | Benham | 204/196.36 |
| 7,909,982 | B2 | * | 3/2011 | Glass et al. | 205/734 |
| 8,002,964 | B2 | * | 8/2011 | Glass et al. | 205/734 |
| 2004/0055897 | A1 | | 3/2004 | Lessing | |
| 2004/0186221 | A1 | * | 9/2004 | Pitchumani et al. | 524/556 |
| 2007/0158184 | A1 | * | 7/2007 | Benham | 204/196.06 |
| 2007/0187854 | A1 | * | 8/2007 | Sirola et al. | 264/35 |
| 2008/0105564 | A1 | * | 5/2008 | Glass et al. | 205/734 |
| 2011/0168571 | A1 | * | 7/2011 | Glass et al. | 205/734 |
| 2011/0303530 | A1 | * | 12/2011 | Glass et al. | 204/196.01 |

FOREIGN PATENT DOCUMENTS

| | | | |
|---|---|---|---|
| WO | 2004-044270 | A1 | 4/2004 |
| WO | 2007-026364 | A2 | 3/2007 |

* cited by examiner

POLYMERIC, NON-CORROSIVE CATHODIC PROTECTION ANODE

CROSS-REFERENCE TO RELATED APPLICATIONS

This application claims priority under 35 U.S.C. §119(e) to provisional application No. 61/072,373, filed Mar. 31, 2008, which is incorporated herein by reference for all purposes.

BACKGROUND OF THE INVENTION

1. Field of the Invention

The present invention relates generally to electrodes or anodes for use in the cathodic protection of metallic structures from corrosion. More particularly, the present invention relates to anodes for use in impressed current cathodic protection schemes and provides an anode that is resistant to corrosion and deterioration in use.

2. Summary of the Prior Art

Cathodic protection (CP) is a technique by which corrosion of metal surfaces is controlled by making the metal surface operate as the cathode of an electrochemical cell. This may be accomplished by placing another, more easily corroded, metal in contact with the metal to be protected to act as the anode of the electrochemical cell. The more easily corroded metal is known as a galvanic or "sacrificial" anode. CP systems are commonly used to protect steel structures or apparatus, particularly where the steel structure is subterranean or under water.

For larger structures, galvanic or sacrificial anodes cannot economically deliver enough current to provide adequate corrosion protection for the structure. In those cases, impressed current cathodic protection (ICCP) systems use anodes connected to a direct current power source that is commonly referred to as a CP rectifier. The anodes of ICCP systems typically are rod-shaped or ribbons of various specialized materials, including silicon cast iron, graphite, mixed metal oxide, platinum and/or niobium coated metals, and others. These anodes can be expensive and fragile.

Because such anodes frequently are buried in a borehole, or are exposed to seawater in an offshore application, they are subject to corrosion and deterioration. In addition to degrading the physical structure of the anode, corrosion and deterioration can cause the resistance of the anode to increase, diminishing the efficiency of the cathodic protection cell or circuit. Furthermore, in subterranean applications, common in the protection of oil field equipment and pipelines, corrosion of exotic metal anodes in ground water or soil can lead to ground water or soil contamination.

A need exists, therefore, for anodes or electrodes for use in ICCP systems that do not suffer from the disadvantages of the prior art.

SUMMARY OF THE INVENTION

It is a general object of the present invention to provide an improved anode or anode assembly for use in impressed current cathodic protection applications. This and other objects of the invention are achieved by providing an apparatus for protection of metallic materials from corrosion comprising an electrical power source and a conductor coupled to the power source. An anode is electrically coupled to the conductor. The anode is configured to be secured proximal the metallic materials to be protected from corrosion and has an exterior surface formed predominantly of electrically conductive polymer and an interior filled with particulate carbonaceous material.

According to an illustrative embodiment of the invention, the anode comprises a hollow cylinder formed of electrically conductive polymer, the cylinder having an interior. A metallic tube is secured to and in electrical communication with the interior of the cylinder. An anode conductor is electrically coupled to the metallic tube and extends from the interior of the cylinder to the exterior of the cylinder for connection to the conductor coupled to the power source.

According to an illustrative embodiment of the invention, the electrically conductive polymer is polypropylene with carbon material dispersed therein.

According to an illustrative embodiment of the invention, the carbon material includes carbon nanotubes.

According to an illustrative embodiment of the invention, the particulate carbonaceous material is 99.9% by weight carbon.

According to an illustrative embodiment of the invention, the power source is a direct current power source.

According to an illustrative embodiment of the invention, the anode assembly is disposed in a borehole with a backfill of carbonaceous material filling the borehole and surrounding the anode.

According to another object or aspect of the invention, the anode is manufactured by securing an electrically conductive metallic tubular conductor member to an inner diameter of a tubular exterior member formed of electrically conductive polymer, wherein the tubular conductor member and tubular exterior member are secured together and in electrical communication with one another. An electrical conductor is secured to the tubular conductor member. The tubular exterior member then is filled with a particulate carbonaceous material. The tubular exterior member is then enclosed, wherein the particulate carbonaceous material is secured and enclosed within the tubular exterior member and the electrical conductor is arranged for electrical connection to a power cable.

Other objects, features, advantages and aspects of the present invention will become apparent with reference to the Figures and the Detailed Description, which follow.

BRIEF DESCRIPTIONS OF THE DRAWINGS

DETAILED DESCRIPTION OF THE PRESENT INVENTION

Figure 1:
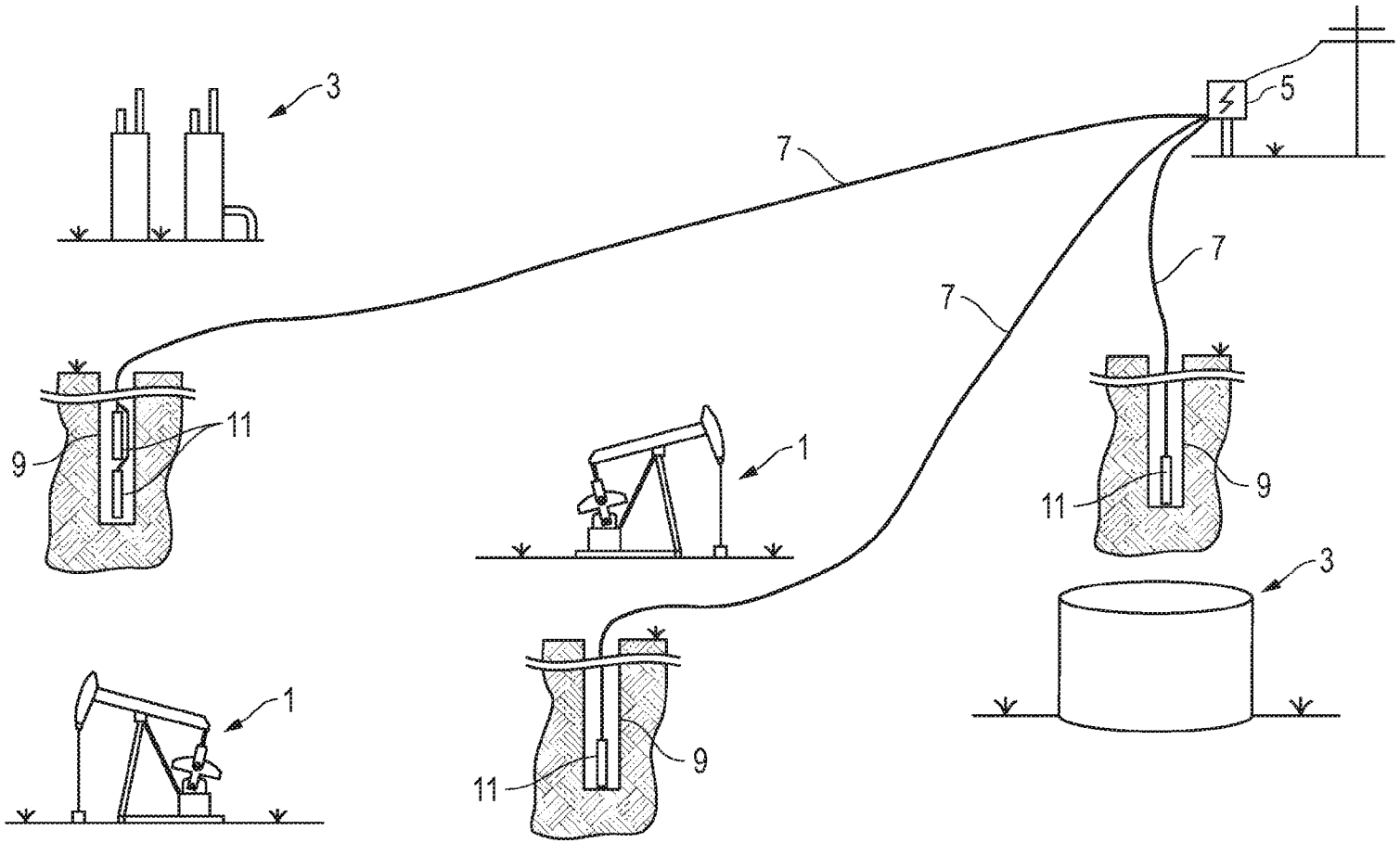
FIG. 1 is a schematic depiction of an exemplary ground bed of an ICCP of the type contemplated by the present invention.

Referring now to the Figures, and particularly to FIG. 1, an onshore ICCP ground bed is shown that is illustrative of the application for the anode in accordance with the present invention. The exemplary ground bed is an onshore oil production field having various oil field equipment, such as a pump jack and sucker-rod pump 1, and a separator and storage tank 3, and associated subterranean piping. A typical production field such as illustrated in FIG. 1 may contain many sucker-rod pumps 1 and associated equipment such as separators, storage tanks 3 and the like. Such structures are typically formed of steel, iron or other metals subject to corrosion and include portions that extend underground (e.g. cased wellbores, piping, foundation members, etc.), compounding the likelihood of corrosion. Accordingly, such production fields are frequently provided with ICCP systems to deter corrosion of such equipment and avoid frequent costly replacement. Such an ICCP includes a rectifier 5, which is coupled to available alternating-current power, typically 220 Volt line power. Rectifier 5 typically is a rectifier that rectifies the AC input to a lower voltage direct-current output, with a typical output being in the range of 20 VDC and 20 AmpDC. Some rectifiers operate on solar power, thermo-electric power, or are powered by natural gas produced on-site, but these are generally lower powered and less suitable for a ground bed of the size necessary to protect a production field.

The DC output of rectifier 5 is carried by cables or conductors 7 to various selectively placed boreholes 9 in which are located one or more anodes 11 in accordance with the present invention. Typically, boreholes 9 and anode(s) 11 therein are proximal the structures to be protected. By impressing a current or electromotive force between anodes 11 and the various steel or metallic structures such as sucker-rod pump 1 and separator 3, which act as cathodes, corrosion of the structures can be substantially prevented. Anode 11 in accordance with the present invention is particularly adapted for subterranean use such as in the exemplary ground bed illustrated in FIG. 1. Anode 11 according to the present invention can also be adapted for use in offshore oil field and other submarine applications (where water rather than the earth completes the electrochemical circuit), to protect subterranean pipelines, bridges, building foundations, as well as other ICCP applications where a corrosion- and deterioration-resistant anode is desirable.

Figure 2:
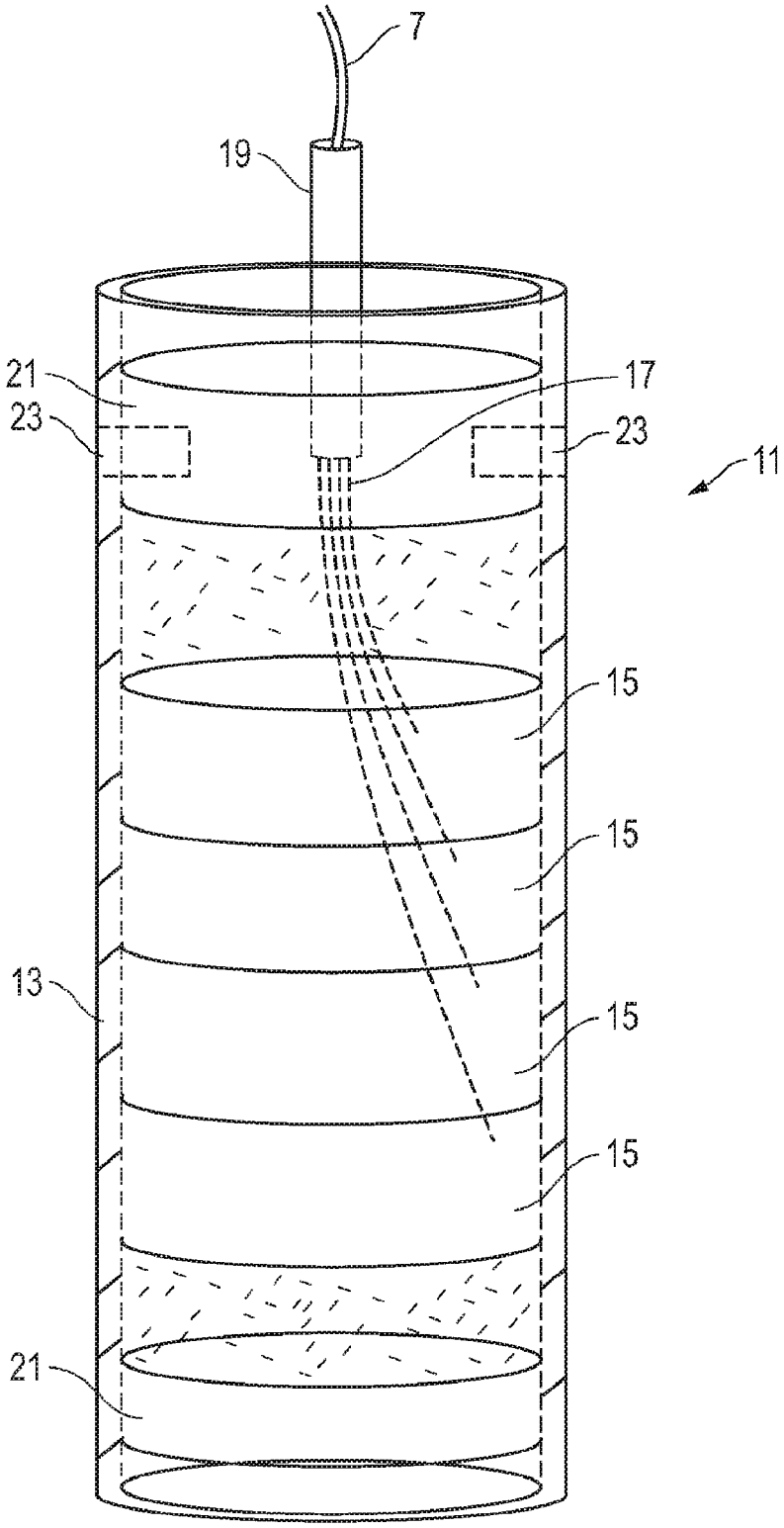
FIG. 2 is an elevation view, partially in section, of an illustrative embodiment of an anode according to the present invention.

FIG. 2 depicts an illustrative or exemplary embodiment of an anode or electrode 11 in accordance with the present invention. The illustrative embodiment disclosed is only a preferred embodiment. Specific dimensions, materials and processes described are illustrative only, and susceptible to modification. The major component of anode 11 preferably is an exterior member 13 that may be a hollow, tubular and cylindrical body that is formed of an electrically conductive polymer. According to the illustrative embodiment of the present invention, the electrically conductive polymer is polypropylene that is "filled" with (has dispersed throughout) electrically conductive particles, including carbon "nanotubes" (sometimes described as graphitic carbon in a crystalline state in which each atom is bonded trigonally in a curved sheet that forms a hollow tube). A preferred electrically conductive polymer is available from TheMIX Plastics, Inc. of Lake Mills, Wis. under the designation THE-CON 5-999X56155-B. The preferred polymer has the following composition:

| | |
|---|---|
| Poly(1-methylethylene) (polymer base) | 40-70% by weight |
| Graphite flake | 10-30% by weight |
| Carbon fiber (nanotubes) | 1-20% by weight |
| Carbon black | 10-30% by weight |
| Copper | <2% by weight |
| Proprietary stabilizers and dispersion aids | <3% by weight |

Preferably, the electrically conductive polymer is conventionally extruded into a tube having an outer diameter of 2.50 inches and an inner diameter of 2.00 inches. The length of the resulting hollow cylinder or tubular member 13 can be selected in accordance with the amperage (or other physical properties) requirements of the individual anode or the ICCP. Cylinder 13 forms the exterior of anode 11 according to an illustrative embodiment of the present invention.

An electrically conductive tube 15, preferably copper, is disposed generally concentrically within the interior of cylinder 13 and is physically secured in electrical communication or coupling with the inner diameter of electrically conductive polymer cylinder 13. According to an illustrative embodiment of the present invention, tube 15 is slit lengthwise (parallel to its central axis) and is inserted into cylinder 13 with a layer of electrically conductive adhesive on the exterior of tube 15 and/or interior of cylinder 13. A preferred electrically conductive adhesive is known as Amazing GOOP™ Plumbing, an epoxy adhesive manufactured and sold by Eclectic Products Inc. Preferably, a heated mandrel is inserted within cylinder 13 and inner diameter of tube 15 and is used to radially expand the tube approximately 0.135 inches into close physical contact or interference fit with the inner diameter of cylinder 13. Alternatively, the polymer can be injection-molded around the conductive tube(s), which requires that the ends of tube 15 be at least temporarily enclosed prior to the injection molding of the polymer. Similarly, the electrically conductive polymer can be co-extruded over and with the tube(s) to effect the secure mechanical and electrical connection. Also, alternatively, the electrically conductive polymer can be rendered into a flowable or liquid state by the addition of heat and/or solvent and can be applied over tube 15 by hot-nitrogen spraying or similar process.

Tube 15 is thereby both physically secured and in good electrical communication or coupling with the electrically conductive polymer of cylinder 13. In long (e.g. 72 inch) anodes 11, several (e.g. four in a 72 inch anode) 12-inch lengths of tube 15 preferably are inserted and secured (as previously described) equally longitudinally spaced along the length of cylinder 13. The use of a metallic, conductive tube or tubular member 15 maximizes the contact area between the tube and the polymer of exterior cylinder 13 and decreases the resistivity of anode 11. Additionally, use of a tube minimizes the amount of expensive metal in the assembly.

An electrical conductor 17, preferably 10 gage stranded copper wire, is soldered to each portion or length of tube 15 and wires 17 are bundled together at the upper end of cylinder 13. Each wire or electrical conductor 17 preferably is inserted into a small (smaller-diameter, e.g. 0.25 inch) electrically conductive, preferably copper, tube 19 that is crimped at its lower end over wires 17 and the joint soldered (a butt-splice) to ensure the integrity of the electrical connection.

The interior of cylinder 13, including the interior of tube(s) 15, is filled with particulate carbonaceous material, preferably comprising 99.9% by weight carbon in the form of carbon black and/or crushed graphite. This material avoids buoyancy of the anode and assists in heat dissipation in the anode and provides a conductive path throughout the volume of the anode without the use of metallic conductors. Lower weight percentages of carbon can be used, but corrosive or caustic components should be avoided. The fill material, as mentioned, should be electrically conductive, non-corrosive, and not subject to corrosion itself.

The ends of cylinder 13 preferably are closed with a pair of end caps 21. End caps 21 may be made of PVC and may be secured in place using epoxy adhesive. Alternatively or additionally, end caps 21 may be secured to cylinder 13 via threads. At the upper end, three dowels 23 may be inserted through bores spaced 120 degrees about the circumference of cylinder 13 and into aligned bores in the upper end cap 21. Dowels 23 may be secured in place, using an adhesive such as an epoxy, to provide structural integrity to the often loadbearing upper end of anode 11. End caps 21 preferably are recessed from the ends of cylinder 13 approximately 0.25 inches and the space is filled or potted with epoxy adhesive that is capable of adhering to the surrounding surfaces and curing to a solid, strong, polymeric material. Thus, the interior of cylinder 13 is enclosed and the filler material is captured or retained therein. End caps 21 and potting material provide a water-resistant seal that inhibits penetration of the anode by water or other fluids and assists in preventing corrosion of internal components such as tube 15, wires 17, and small tube 19.

Small tube 19 extends through upper end cap 21 to provide a butt-splice connection for cable 7, which is, in turn, electrically connected or coupled to rectifier or power source 5. Preferably, the bore in end cap 21 through which small tube 19 extends is sealed with epoxy and only a relatively small portion (preferably no more than 0.25 inches, so that the end of tube 19 is flush with the end of cylinder 13) of small tube 19 extends from the upper end cap of anode 11 and is also covered with epoxy.

The resulting anode structure has an exterior or exterior surface that is substantially (ideally entirely) composed of corrosion-resistant polymeric materials, and predominantly of electrically conductive polymer. For example, for an anode 72 inches in length having an outer diameter of 2.5 inches and an electrically conductive polymer cylinder 13 wall thickness of 0.25 inches, the ratio of the area of the non-conductive polymeric (PVC) end caps 21 (or the epoxy potting material covering end caps 21) to the area of the entire exterior surface of anode 11 is less than 1:10, so that more than 90% of the exterior surface of anode is electrically conductive polymer. Thus, little or no metallic material that is subject to corrosion is exposed in the anode according to the present invention, and the vast majority or predominant portion of the exterior surface of anode 11 is electrically conductive. For purposes of this application, "predominantly" means greater than approximately 75%.

Figure 3:
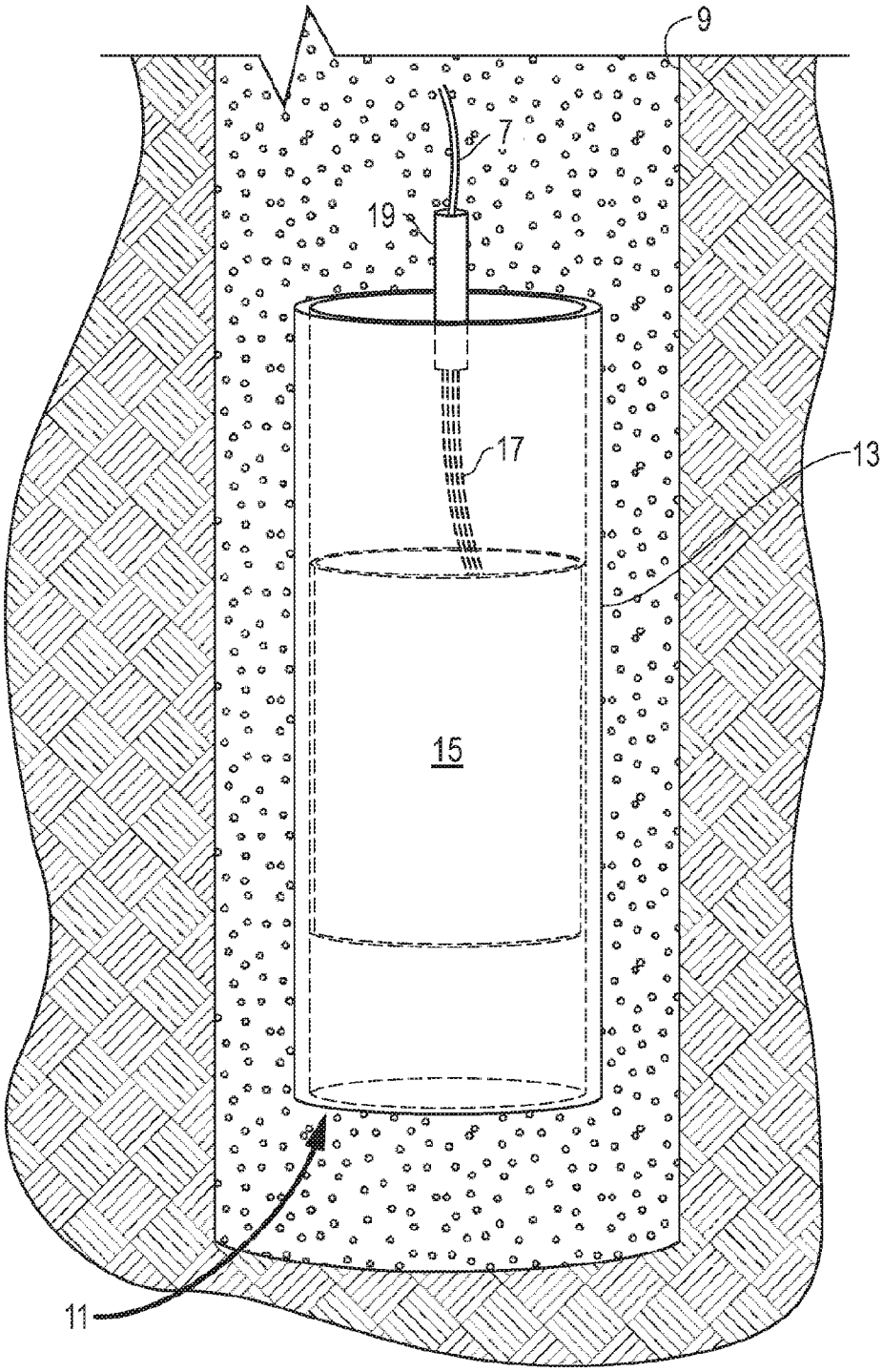
FIG. 3 is an elevation view, partially in section, of the anode according to the present invention of FIG. 2 assembled in situ in a borehole.

In a preferred but illustrative use in an ICCP, anode 11 is inserted or disposed in a borehole 9 of selected depth in accordance with the design of the ICCP ground bed, as depicted in FIG. 3. Borehole 9 then is backfilled with particulate carbon or carbonaceous material that preferably is the same as that filling the interior of anode cylinder 13. Conventional anode constructions use coke breeze as a backfill. However, coke breeze often contains small but effective amounts of corrosive materials such as sulfur or alkaline chemicals, and thus provides an even more corrosive environment than might normally exist in a borehole. According to the preferred illustrative embodiment of the present invention, the backfill material is 99.9% by weight carbon, which may comprise carbon black and/or graphite.

The entire assembly then functions as an anode when power is applied from rectifier 5. Electrical contact and communication is established between rectifier 5 and anode 11 through cable 7. Good electrical contact between anode 11 and the earth (and in turn the metallic cathode structure(s) to be protected) is established by the almost entirely or predominantly electrically conductive exterior 13 of anode 11 through the carbon backfill and borehole 9. The metallic structures to be protected (pump 1 and associated structures, and portions of separator and storage tank 3 in the example of FIG. 1), function as cathodes in the electrochemical circuit and are thus protected from corrosion. The anode itself, formed predominantly of electrically conductive polymer (polypropylene), resists corrosion and deterioration within borehole 9 and accordingly lasts longer and poses less environmental hazard than conventional graphite or metallic anodes, which can cause ground water contamination upon corrosion or deterioration.

Basic testing of the anode structure described above, consisting of applying the leads of an ohmmeter to the exterior surface of cylinder 13 and to the conductor (wire 17 or small tube 19), yields total resistance of the 72-inch anode 11 in the range of about 0.001 Ohm. More realistic testing, in which an anode as constructed above is immersed in the particulate carbon backfill and coupled to a rectifier, and using a reference cathode also immersed in the carbon material, yields a current between about 15.5-17 Ampere with an applied voltage of 2 Volts DC, indicating a resistance of the entire anode assembly (including the backfill as described in FIG. 3) of about 0.111 to 0.130 Ohm. Thus, the resistance of anodes according to the present invention is comparable to or lower than more conventional graphite or metallic anodes. Further, because the predominantly polymeric anode is corrosion- and deterioration-resistant, it is able to maintain low resistance levels over a longer period of time than conventional anodes, thereby avoiding or minimizing costly replacement.

The invention has been described with reference to preferred or illustrative embodiments thereof. It is thus not limited, but is subject to variation and modification without departing from the scope of the claims, which follow.

I claim:

1. An apparatus for protection of metallic materials from corrosion comprising:

an electrical power source;

a conductor coupled to the power source; and an anode electrically coupled to the conductor, the anode configured to be secured proximal to the metallic materials to be protected from corrosion, the anode having an exterior surface formed predominantly of an electrically conductive polymer and an interior filled with a particulate carbonaceous material.

2. The apparatus of claim 1, wherein the anode further comprises:

a hollow cylinder formed of the electrically conductive polymer, the cylinder having an interior and an exterior;

a metallic tube secured to and in electrical communication with the interior of the cylinder; and an anode conductor electrically coupled to the metallic tube and extending from the interior of the cylinder to the exterior of the cylinder for connection to the conductor coupled to the power source.

3. The apparatus of claim 1, wherein the electrically conductive polymer is polypropylene with carbon material dispersed therein.

4. The apparatus of claim 3, wherein the carbon material includes carbon nanotubes.

5. The apparatus of claim 1, wherein the particulate carbonaceous material is 99.9% by weight carbon.

6. The apparatus of claim 1, wherein the power source is a direct current power source.

7. An apparatus for protection of metallic materials from corrosion comprising:

a power source;

a conductor coupled to the power source;

an anode electrically coupled to the conductor and configured to be secured proximal to the metallic materials to be protected from corrosion, the anode having an exterior surface formed of an electrically conductive polymer and having an interior substantially filled with a particulate carbonaceous material.

8. The apparatus of claim 7, wherein the anode further comprises:

a hollow cylinder formed of the electrically conductive polymer, the cylinder having an interior and an exterior;

a metallic tube secured to and in electrical communication with the interior of the cylinder; and an anode conductor electrically coupled to the metallic tube and extending from the interior of the cylinder to the exterior of the cylinder for connection to the conductor coupled to the power source.

9. The apparatus of claim 8, wherein the electrically conductive polymer is polypropylene with carbon material dispersed therein.

10. The apparatus of claim 9, wherein the carbon material includes carbon nanotubes.

11. The apparatus of claim 7, wherein the particulate carbonaceous material is 99.9% by weight carbon.

12. The apparatus of claim 7, wherein the power source is a direct current power source.

13. An anode assembly for use in a ground bed of anodes in an impressed current cathodic protection system having an electric power source, each anode being disposed in a borehole formed in the earth, the anode assembly comprising:

the anode having an exterior formed of an electrically conductive polymer and configured for connection to the electric power source, the anode being disposed in the borehole; and a backfill of 99.9% by weight carbon at least partially filling the borehole and surrounding the anode.

14. The anode assembly of claim 13, wherein the anode further comprises:

a cylindrical tube member formed of the electrically conductive polymer, the tube member having an inner diameter;

a metallic conductor tube secured to and in electrical communication with and at least partially coextensive with the inner diameter of the cylindrical tube member;

a carbonaceous filler material filling the cylindrical tube member; and an electrical conductor secured in electrical communication with the metallic conductor tube, the conductor being configured for electrical connection to electric power source.

15. The anode assembly of claim 13, wherein the electrically conductive polymer is polypropylene having carbon nanotubes dispersed therein.

16. The anode assembly of claim 14, wherein the metallic conductor tube is a copper tube.

17. The anode assembly of claim 14, wherein the carbonaceous filler material is 99.9% by weight carbon.

18. The anode assembly of claim 14, further comprising a pair of end caps for enclosing the cylindrical tube member.

19. A method of manufacturing an anode for use in an impressed current cathodic protection apparatus, the method comprising the steps of:

forming a tubular exterior member of an electrically conductive polymer, the tubular exterior member having an inner diameter;

forming a tubular conductor member of a conductive metal;

securing the tubular conductor member to the inner diameter of the tubular exterior member, wherein the tubular conductor member and tubular exterior member are secured together and in electrical communication with one another;

securing an electrical conductor to the tubular conductor member;

filling the tubular exterior member with a particulate carbonaceous material; and enclosing the tubular exterior member, wherein the particulate carbonaceous material is secured and enclosed within the tubular exterior member and the electrical conductor is arranged for electrical connection to a power cable.

20. The method of claim 19, wherein the step of securing the tubular conductor member to the inner diameter of the tubular exterior member further comprises:

adhering an exterior of the tubular conductor member to an interior of the tubular exterior member; and radially expanding the tubular conductor member into close physical contact with the interior of the tubular exterior member.

21. The method of claim 19, wherein the steps of forming the tubular exterior member and the tubular conductor member, and the step of securing them together further comprises:

injection-molding the tubular exterior member over the tubular conductor member.

22. The method of claim 19, wherein the steps of forming the tubular exterior member and the tubular conductor member, and the step of securing them together further comprises:

rendering the electrically conductive polymer into a flowable state; and applying the flowable electrically conductive polymer over the exterior of the tubular conductor member.

23. The method of claim 19, wherein the step of enclosing the tubular exterior member further comprises:

securing an end cap on each end of the tubular exterior member.

24. A method of manufacturing an anode for use in an impressed current cathodic protection apparatus, the method comprising the steps of:

securing an electrically conductive metallic tubular conductor member to an inner diameter of a tubular exterior member formed of an electrically conductive polymer, wherein the tubular conductor member and tubular exterior member are secured together and in electrical communication with one another;

securing an electrical conductor to the tubular conductor member;

filling the tubular exterior member with a particulate carbonaceous material; and enclosing the tubular exterior member, wherein the particulate carbonaceous material is secured and enclosed within the tubular exterior member and the electrical conductor is arranged for electrical connection to a power cable.

25. The method of claim 24, wherein the step of securing the tubular conductor member to the inner diameter of the tubular exterior member further comprises:

adhering an exterior of the tubular conductor member to an interior of the tubular exterior member; and radially expanding the tubular conductor member into close physical contact with the interior of the tubular exterior member.

26. The method of claim 24, wherein the step of securing the tubular conductor member to the inner diameter of the tubular exterior member further comprises:

molding the tubular exterior member over the tubular conductor member.

27. The method of claim 24, wherein the step of securing the tubular conductor member to the inner diameter of the tubular exterior member further comprises:

rendering the electrically conductive polymer into a flowable state; and applying the flowable electrically conductive polymer over an exterior of the tubular conductor member.

28. The method of claim 24, wherein the step of enclosing the tubular exterior member further comprises:

securing an end cap on each end of the tubular exterior member.

* * * * *